United States Patent [19]

Krasnov

[11] Patent Number: 4,791,997

[45] Date of Patent: Dec. 20, 1988

[54] PIPE HANDLING APPARATUS AND METHOD

[75] Inventor: Igor Krasnov, Houston, Tex.

[73] Assignee: Vetco Gray Inc., Houston, Tex.

[21] Appl. No.: 142,105

[22] Filed: Jan. 7, 1988

[51] Int. Cl.[4] ..... E21B 19/06; E21B 19/16

[52] U.S. Cl. ..... 175/57; 166/77.5; 175/85; 175/423; 414/22.51

[58] Field of Search ..... 175/85, 113, 52, 162, 175/203, 220, 423; 166/77.5, 78, 85; 414/22, 745, 910; 81/57.34, 57.35

[56] References Cited

U.S. PATENT DOCUMENTS

| | | | |
|---|---|---|---|
| 3,526,425 | 9/1970 | Langowski et al. | 294/82 |
| 3,776,320 | 12/1973 | Brown | 175/85 X |
| 3,840,128 | 10/1974 | Swoboda, Jr. et al. | 414/728 |
| 3,986,569 | 10/1976 | Hilding et al. | 175/52 |
| 4,013,178 | 3/1977 | Brown et al. | 414/22 |
| 4,274,778 | 6/1981 | Putnam et al. | 414/22 |
| 4,345,864 | 8/1982 | Smith, Jr. et al. | 414/22 |
| 4,440,536 | 4/1984 | Scaggs | 414/22 |
| 4,449,596 | 5/1984 | Boyadjieff | 175/85 |
| 4,589,503 | 5/1986 | Johnson et al. | 175/113 |
| 4,605,077 | 8/1986 | Boyadjieff | 175/85 |
| 4,625,796 | 12/1986 | Boyadjieff | 175/85 X |
| 4,667,752 | 5/1987 | Berry et al. | 175/85 |

*Primary Examiner*—Stephen J. Novosad
*Attorney, Agent, or Firm*—James E. Bradley

[57] ABSTRACT

A pipe handling apparatus for a drilling rig is mounted on the rig floor. The drilling rig has a top drive with a power drive stem. Elevators are suspended below the drive stem. The lifting member has a supporting arm to receive the bottom of a stand of drill pipe lifted by the elevators. A stabilizing arm is mounted to the lifting member above the supporting arm to stabilize the stand. The lifting member telescopes upward to slide the stand of drill pipe upward through the elevators and into engagement with the drive stem.

7 Claims, 3 Drawing Sheets

PIPE HANDLING APPARATUS AND METHOD

CROSS-REFERENCE TO RELATED APPLICATION

This application is being filed simultaneously with an application Ser. No. 142,104, by the same inventor entitled "Stabilizer For Drilling Rig Elevators" which discloses common subject matter.

BACKGROUND OF THE INVENTION

1. Field of the Invention

This invention relates in general to equipment for handling drill pipe on a drilling rig, and in particular to equipment for lifting drill pipe from the rig floor for connection to a power drive carried in the derrick.

2. Description of the Prior Art

A top drive drilling rig uses a driven drive stem carried in the derrick for rotating the drill pipe. This differs from the majority of drilling rigs, which have a driven rotary table on the rig floor through which a square kelly passes for rotating the drill pipe. One advantage of a top drive system is that it enables the driller to connect a triple stand of three joints or sections of drill pipe onto the top of the drill string. He then will drill the triple stand down to a point next to the rig floor, then add another triple stand. With conventional rotary table rigs, normally only single joint can be drilled down at one time because of the length of the kelly.

One problem, however, with top drive drilling rigs is in connecting the stand of drill pipe to the drive stem. Because the drive stem will be more than 90 foot above the rig floor while making the connection, the driller will have a difficult time in seeing the connection being made up. Normally the driller will lower the drill stem until it contacts the upper end of the stand. Then he will rotate the drive stem to secure it to the stand. A stabbing bell is mounted around the drive stem to align the drive stem with the stand as the drive stem is lowered onto the stand. Nevertheless, cross threading is not infrequent. This damages the threads.

One apparatus employed to avoid such an occurrence is mounted in the derrick below the drive stem and is described in U.S. Pat. No. 4,667,752, Joe R. Berry ed al., issued May 26, 1987. This device grabs a stand of drill pipe, picks it up and inserts in into engagement with the drive stem. While successful, the apparatus adds additional weight in the derrick and requires a power supply in the derrick. Pipe handling devices for mounting to a rig floor are known in general, but not specifically for top drive drilling rigs.

SUMMARY OF THE INVENTION

In this invention, a lifting means is mounted to the rig floor. The lifting means is a telescoping member that is vertically movable between a lower position and an upper position. A supporting arm is mounted to the lifting means. The supporting arm has a receptacle for receiving the threaded pin of one of the stands of drill pipe.

A driller picks up the stand of drill pipe and one of the floorhands will guide the drill pipe over onto the receptacle of the supporting arm. A centralizing arm spaced above the supporting arm has jaws to receive the stand of drill pipe as it is swung over toward the telescoping member. The centralizing member has springs to deflect the jaws due to shock of the stand contacting the jaws. Once the stand is positioned on the supporting arm, the telescoping member is moved up to lift the stand into engagement with the drive stem in the derrick.

DESCRIPTION OF THE PREFERRED EMBODIMENT

Figure 1:
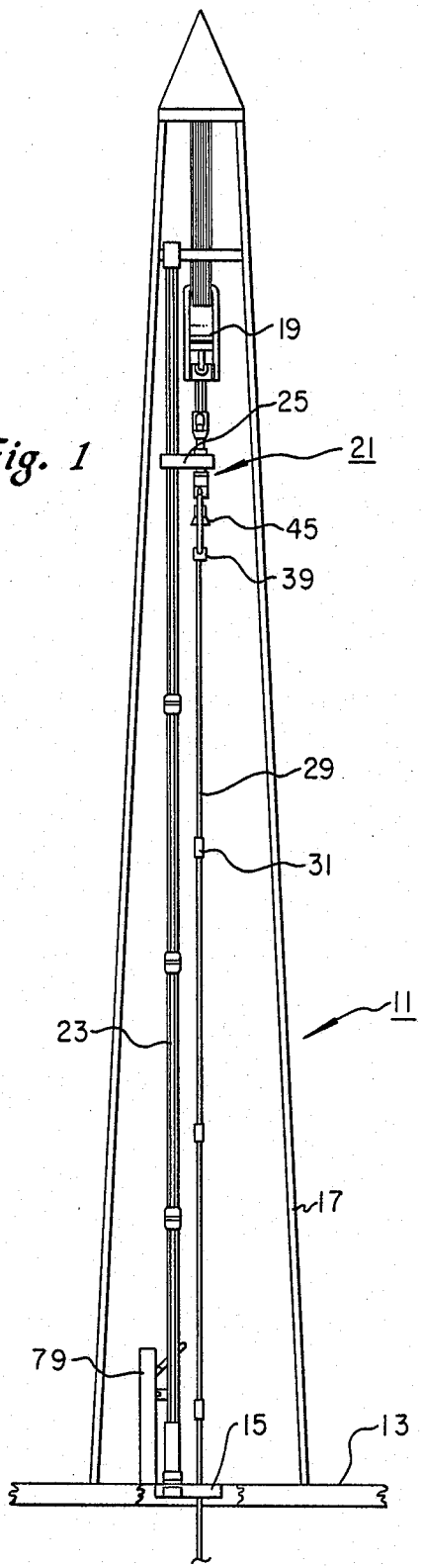
FIG. 1 is a schematic side view of a drilling rig constructed in accordance with this invention.

Referring to FIG. 1, drilling rig 11 has a rig floor 13. A bushing 15 is located in the rig floor 13. A derrick 17 extends upward from the rig floor 13. A set of travelling blocks 19 are carried on cables in the derrick 17.

A power drive assembly 21 is carried in the derrick 17 by the block 19. The power drive assembly 21 in the preferred embodment derives its power from a rectangular, vertical drive shaft 23. A drive head 25 mounted to the power drive assembly 21 slides up and down the drive shaft 23. The drive shaft 23 is connected by a transmission (not shown) to a power source at the rig floor 13. An alternate type of top drive system (not shown) employs an electrical motor located in the derrick.

Figure 2:
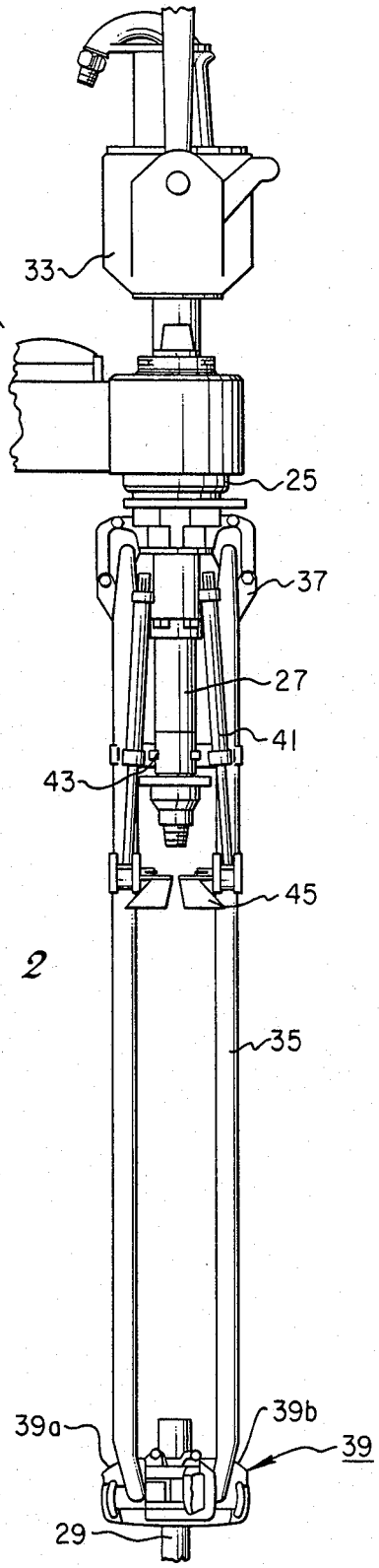
FIG. 2 is an enlarged side view of the drive head assembly, elevators and associated equipment of the drilling rig of FIG. 1.

Referring to FIG. 2, the drive head 25 rotates a tubular, hollow drive stem 27. The drive stem 27 is threaded on its lower end for connection to the upper end of a stand of drill pipe 29 (FIG. 1). Drill pipe 29 is conventional and made up of sections about 30 feet long, each having a tool joint 31 on each end for connection to the other sections of drill pipe 29. The derrick 17 will be sufficiently high to support a stand with three of the sections of the drill pipe 29 above the rig floor 13.

Referring again to FIG. 2, the drive assembly 21 includes a swivel 33 on its top for connection to a mud hose (not shown) for supplying drilling fluid. A pair of links or bails 35 are suspended from a non-rotating portion of the drive head 25. Each link 35 is supported by a hook 37. This allows the links 35 to swing relative to the drive head 25. Each link 35 extends downward a considerable distance past the drive stem 27. Each link 35 has a longitudinal axis that is substantially parallel with the axis of the derrick 17 (FIG. 1) when the links 35 are extending straight downward.

A set of elevators 39 are supported on the lower ends of the links 35. The elevators 39 are conventional. The elevators 39 comprise two halves **39*a*, 39*b* of a clamping device. The elevators 39 will close loosely around the drill pipe 29 below one of the tool joints 31. Lifting the elevators 39 will lift the string of drill pipe 29 by engaging the downward facing shoulder located on each tool joint 31. The elevators 39 when opened cause the links 35 to swing apart a short distance. The elevators 39** are manually opened and closed in the preferred embodiment.

A pair of power fluid cylinders 41 extend between each link 35 and the drive head 25 above the drive stem 27. The power cylinders 41 may be actuated to tilt the links 35 back out of the way. The power cylinders 41 are used while drilling and when the drive stem 27 approaches the rig floor 13 (FIG. 1).

A pair of stabilizers 43 are mounted to the links 35 on opposite sides of the drive stem 27. The stabilizers 43 will loosely clamp to the drive stem 27 while the elevators 39 are closed to prevent the links 35 from swinging. A split stabbing bell 45 is mounted to the links 35 below the drive stem 27. The stabbing bell 45 guides the upper end of the drill pipe 29 into contact with the drive stem 27.

Figure 3:
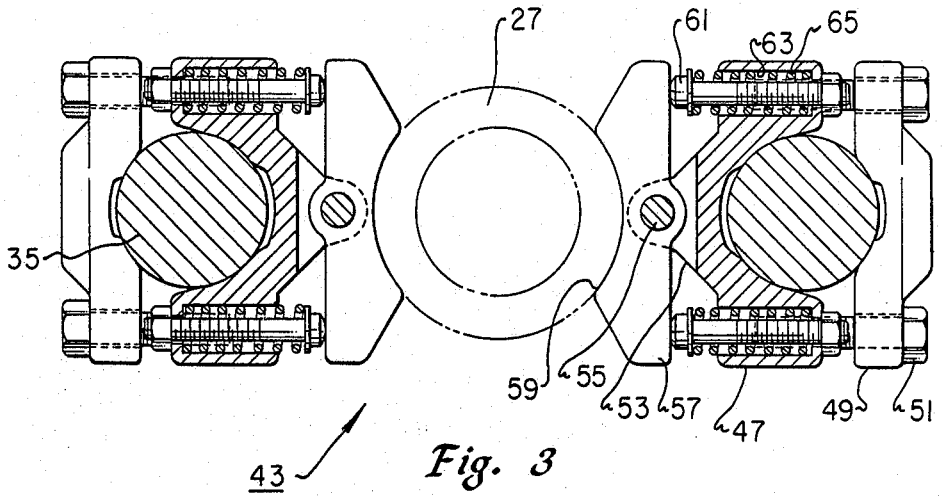
FIG. 3 is a horizontal sectional view of a stabilizer for stabilizing the links shown in FIG. 2.

Referring to FIG. 3, the stabilizers 43 are shown in more detail. A bracket 47 is secured to the inner side of each link 35. A clamp 49 connected by bolts 51 supports the brackets 47 rigidly on each link 35. Each bracket 47 has a hinge 53 on its inner side. The hinge 53 receives a vertical pin 55.

A shoe 57 is mounted to each bracket 47 by means of the pin 55. Each shoe 57 has an arcuate inner face 59. The radius of each face 59 is substantially the same as the radius of the drive stem 27. The dimensions of the bracket 47 and shoe 57 are selected with a slight clearance between the face 59 and drive stem 27, so that the face 59 will lightly contact the drive stem 27 when the elevators 39 (FIG. 2) are closed. The slight clearance allows the drive stem 27 to rotate while drilling without excessive rubbing against the shoes 57.

A pair of plungers 61 are mounted horizontally to each bracket 47. Each plunger 61 extends into a cavity 63 located in each bracket 47. A coil spring 65 urges the plunger 61 outward. The plungers 61 are positioned to engage opposite edges of the shoe 57. The force exerted by each spring 65 is substantially equal. This results in a bias means to bias the shoe 57 against any pivotal movement about the pin 55. The force of the spring 65 is overcome, however, when the elevators 39 (FIG. 2) are opened. At that time, the links 35 are pushed away from the drive stem 27. The shoes 57 will pivot and disengage from the drive stem 27 during this occurrence.

Figure 4:
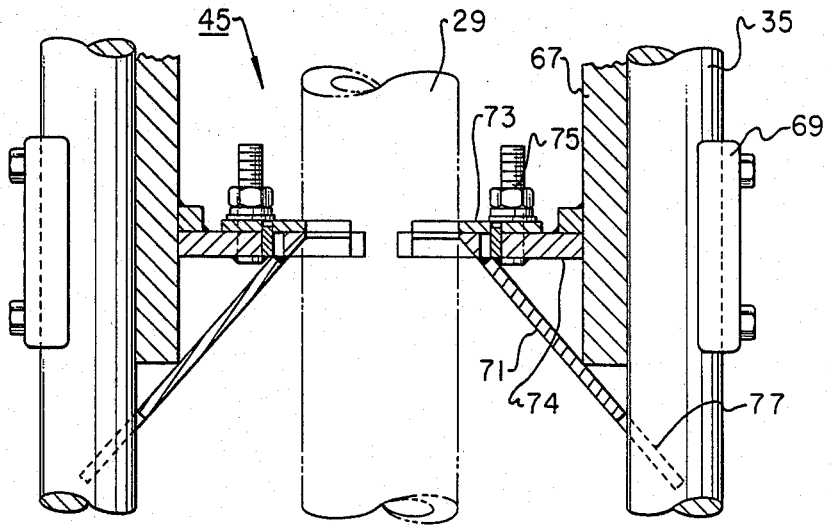
FIG. 4 is a vertical sectional view illustrating the stabbing bell shown in FIG. 2.

Referring to FIG. 4, the stabbing bell 45 is shown in more detail. The assembly includes a bracket 67 which is rigidly clamped to each link 35 by means of a clamp 69. The stabbing bell 45 includes two separate conical sections 71. Each section 71 is slightly less than one-half of a right circular cone. A semi-circular opening for the drill pipe 29 is located in the top of of each section 71. The semi-circular openings define a hole of diameter larger than the diameter of the drill pipe 29. The sections 71 do not touch each other when the elevators 39 (FIG. 2) are closed. A gap will exist between the front edges of the sections 71, as shown in FIG. 2. When the elevators 39 are closed, the gap is not as wide as the diameter of the drill pipe 29.

Each section 71 is supported by a plate 73 which overlies a plate 74 attached to bracket 67. A bolt 75 extends through the plates 73, 74 to connect them together. The hole for the bolts 75 is elongated to allow the sections 71 to be adjusted inward and outward relative to each other for different diameters of drill pipe 29. Each section 71 has a slot 77 cut in its side edge through which the link 35 passes. When the elevators 39 (FIG. 2) are opened and the links 35 are pushed away from the drill pipe 29, the drill pipe 29 wil pass through the gap between the sections 71. The gap widens because the links 35 spread apart some when the elevators 39 are opened. Also, the drill pipe 29 may contact the sections 71 and force the gap wider as the links 35 are being pushed back.

Figure 5:
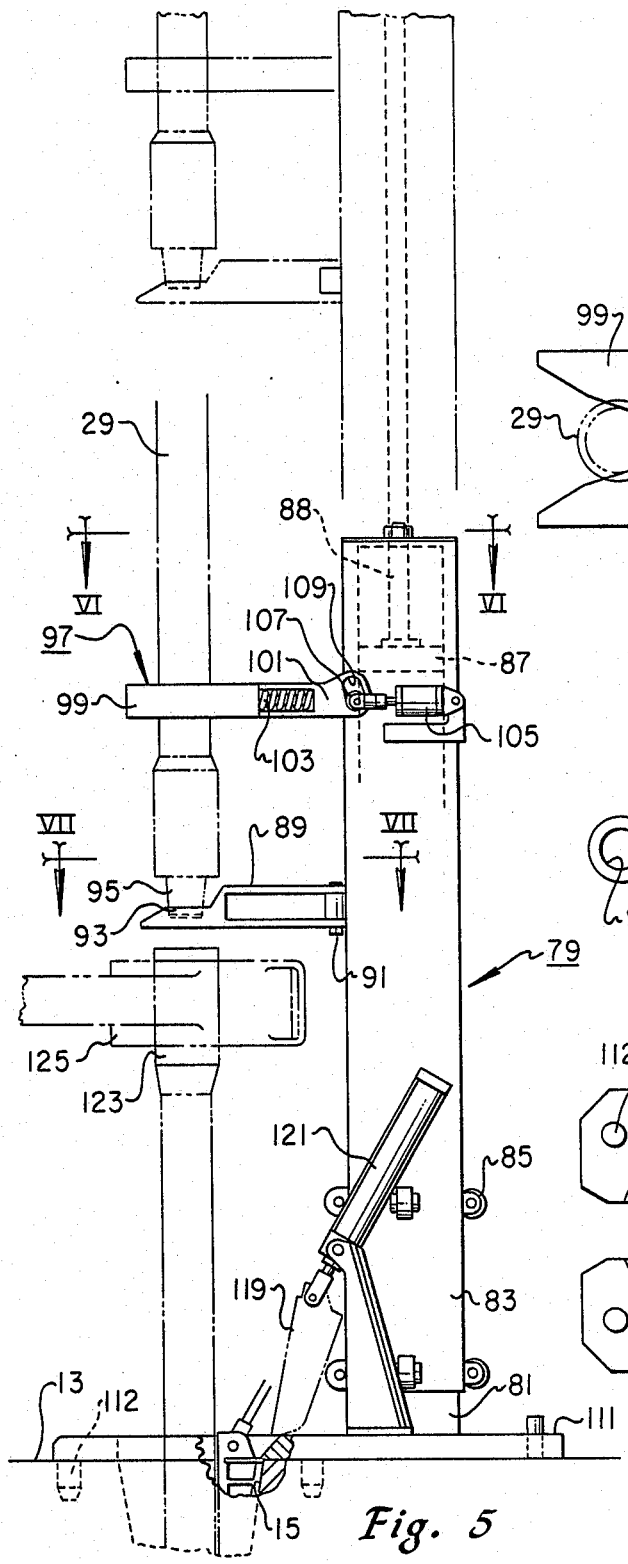
FIG. 5 is a side view illustrating the telescoping lifting member of the drilling rig of FIG. 1.

Referring to FIG. 5, a telescoping lifting member 79 is located on the rig floor 13. The lifting member 79 serves as means for lifting a stand of drill pipe 29 upward relative to the drive stem 27 (FIG. 2). The lifting member 79 has a tubular inner guide 81 that extends vertically upward from the rig floor 13. An outer housing 83 slides telescopingly over the inner guide 81. Rollers 85 mounted on the outer housing 83 facilitate in the telescoping movement. A piston 87 is carried in the inner guide 81. Piston 87 is connected by shaft 88 to the top of the outer housing 83. When a fluid such as air is supplied below the piston 87, it will lift the outer housing 83 upward relative to the inner guide 81, as shown by the dotted lines in FIG. 5.

A supporting arm 89 is mounted to the outer housing 83. The supporting arm 89 is a rigid single piece member of fixed length. It extends horizontally from the outer housing 83. It is connected to the outer housing 83 by a pivot pin 91. The pivot pin 91 allows the supporting arm 89 to be pivoted in a horizontal plane out of the way while other operations are taking place.

A receptacle 93 is located on the outer end of the supporting arm 89. The receptacle 93 is an upward facing circular socket. It is positioned to receive a threaded pin 95 of a stand of drill pipe 29. Soft material is contained in the receptacle 93 to avoid damaging the threaded pin 95. In the operative position, the receptacle 93 will be located vertically above the bushing 15.

Figure 6:
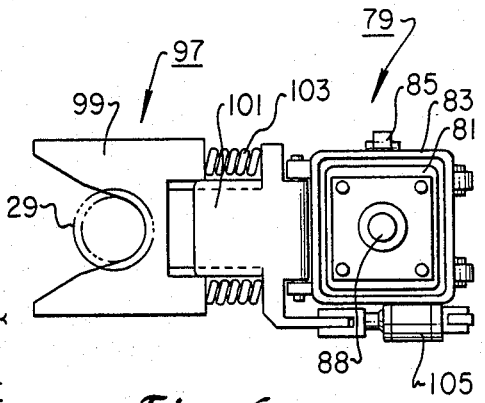
FIG. 6 is a sectional view taken along the line VI—VI of FIG. 5, illustrating the centralizing arm of the telescoping member.
Figure 7:
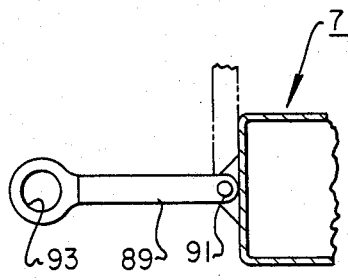
FIG. 7 is a sectional view taken along the line VII—VII of FIG. 5, illustrating the supporting arm for the telescoping member.

A centralizing arm 97 is carried by the outer housing 83 a short distance above the supporting arm 89. The centralizing arm 97 has a pair of jaws 99, as shown in FIG. 6. The jaws 99 are open and are fixed. Jaws 99 are dimensioned to closely receive a section of drill pipe 29. The jaws 99 are mounted on the centralizing arm 97 for inward and outward movement relative to a base 101. The base 101 is mounted on the outer housing 83. Springs 103 urge the jaws 99 outward. When a stand of drill pipe 29 is swung into the jaws 99 with momentum, the springs 103 will deflect, allowing the jaws 99 to move inward relative to the lifting member 79 to absorb shock.

The centralizing arm 97 is also pivotally mounted to the lifting member 79 so that it can be pivoted out of the way. The centralizing arm 97 pivots in a vertical plane. A fluid cylinder 105 is mounted pivotally to the outer housing 83 of the lifting member 79. Fluid cylinder 105 has a cam follower 107 on its piston end. The cam follow 107 engages a hole 109 in the centralizing arm 97. When the fluid cylinder 105 is actuated, the piston retracts. The cam follower 107 will cause the centralizing arm 97 to tilt upward from the horizontal position shown in FIG. 5.

Figure 8:
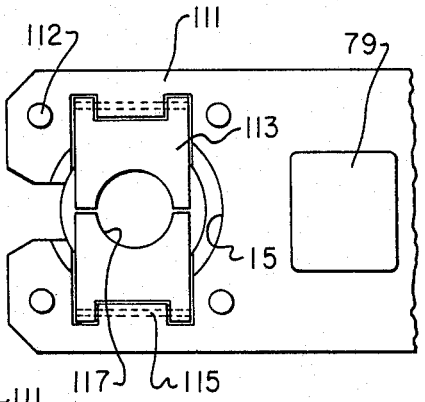
FIG. 8 is a top view, partially sectioned, illustrating a guide plate assembly used with the telescoping member of FIG. 5.

Referring to FIG. 8, the lifting member 79 is supported on the rig floor 13 (FIG. 5) by a supporting plate 111. Supporting plate 111 has locking pins 112 that locate in holes formed in the rig floor 13. A pair of guide plates 113 are pivotally mounted to the supporting plate 111 by hinges 115. Hinges 115 allow the guide plates 113 to be pivoted from an operative position shown in FIG. 8 to an inoperative position. In the operative position, the guide plates 113 will be positioned over the bushing 15 in the rig floor 13, with their edges abutting each other.

Each guide plate 113 has a semi-circular opening 117 on its abutting edge. The openings 117 define a circular opening through which the drill pipe 29 (FIG. 5) passes when the guide plates 113 are in the operative position. The diameter of the combined openings 117 is smaller than the bushing 15 but larger than the tool joints 31 (FIG. 1) on the drill pipe 29. The guide plates 113 center the drill pipe 29 within the bushing 15 and prevent the drill pipe 29 from wearing against the bushing 15.

Referring again to FIG. 5, slips 119 are carried on the supporting plate 111. The slips 119 are connected to a fluid cylinder 121. Cylinder 121 will move the slips 119 between an upper position shown by the dotted lines to a lower position, shown by the solid lines. In the lower position, the slips 119 will locate in the bushing 15. In the lower position, the slips 119 will support the string of drill pipe 29.

In FIG. 5, the upper end of the string of drill pipe 29 is shown being supported by the slips 119. A tool joint box 123 is located on the upper end of each section of drill pipe 29. Tongs 125 of a conventional nature will serve as a backup to grip the tool joint box 123 during makeup and brakeout operations.

In operation, as shown in FIG. 1, while drilling, the drive shaft 23 rotates to rotate the drive stem 27 shown in FIG. 2. The drive stem 27 rotates the string of drill pipe 29 to drill into the earth. Referring to FIG. 2, during drilling the elevators 39 will be closed, fitting loosely around the drill pipe 29 as the drill pipe rotates. The shoes 57 of the stabilizers 43, shown in FIG. 3, will lightly engage the rotating drive stem 27.

When the drive stem 27 nears the rig floor 13, the elevators 39 are opened. The fluid cylinders 41 are actuated to move the links 35 out of the way to allow the drill stem 27 to drill as far as possible. Referring to FIG. 3, when the elevators 39 (FIG. 2) are opened, and the links 35 moved back, the shoes 57 pivot about the pins 55 and disengage from the drive stem 27. When the drill stem 27 is at its lowest point, the drilling is stopped.

Referring to FIG. 5, the fluid cylinder 121 is actuated to lower the slips 119 into the bushing 15. The blocks 19 (FIG. 1) are lowered to cause the slips 119 to support the weight of the string of drill pipe 29. With the tongs 125 in place, the drill stem 27 (FIG. 2) is rotated in reverse to uncouple from the box 123.

Then a triple stand of drill pipe 29 will be made up loosely, with the lowest section of drill pipe 29 positioned in the drilling rig 11 mouse hole (not shown). The upper section of the stand of drill pipe 29 will be supported by the elevators 39. When the elevators 39 are closed around the drill pipe 29, the shoes 57 will slip around and engage the drive stem 27 as shown in FIG. 3. The blocks 19 will be pulled upward, with the elevators 39 picking up the triple stand of drill pipe 29.

The floor hands will guide the lower end of the stand drill pipe 29 over into contact with the centralizing arm 97, shown in FIG. 5. The jaws 99 (FIG. 6) will align the axis of the drill pipe 29 with the receptacle 93. Any shock that occurs as the drill pipe 29 is moved into the jaws 99 will be absorbed by the springs 103. Then the blocks 19 (FIG. 1) are lowered until the threaded pin 95 on the bottom of the stand locates in the receptacle 93 as shown in FIG. 5. As the drill pipe 29 is lowered, it will slide through the jaws 99 of the centralizing arm 97.

Then the driller will apply fluid pressure to the piston 87. This causes the lifting member 79 to telescope, with the outer housing 83 moving upward. The supporting arm 89 and the centralizing arm 97 will move upward in unison with the outer housing 83.

Referring to FIG. 2, as the drill pipe 29 moves upward, it will slide through the elevators 39. The top of the drill pipe 29 will contact and slide through the stabbing bell 45. The alignment of the drill pipe 29 with the drill stem 27 will be controlled by the stabilizers 43, shown in FIG. 3. The stabilizers 43 prevent the links 35 from swinging as the drill pipe 29 moves upward relative to the drill stem 27.

When the top of the drill pipe 29 contacts the drill stem 27, the upward movement of the lifting member 79 (FIG. 5) is stopped. The drill stem 27 is rotated to make an initial makeup of the drill pipe 29 with the drill stem 27. The driller will pick the blocks 19 (FIG. 1) up a short distance, removing the threaded pin 95 of the drill pipe 29 from the receptacle 93 shown in FIG. 5. The driller actuates the fluid cylinder 105 to pivot the centralizing arm 97 upward. A floor hand will manually pivot the supporting arm 89 out of the way.

Then the driller will lower the blocks 19 (FIG. 1), causing the threaded pin 95 to enter the box 123 as shown in FIG. 5. The driller then rotates the drill stem 27 to fully tighten all of the tool joints 31 (FIG. 1) in the stand of drill pipe 29, with the tong 125 serving as a backup. The driller then picks up the entire string of drill pipe 29 a short distance with the blocks 19. He actuates the fluid cylinder 121 to pull the slips 119 to the inoperative position, shown in FIG. 5. The drill pipe 29 can then be lowered back until the drill bit (not shown) contacts the bottom of the well. A floor hand will move the two guide plates 113 in place. Drilling will then commence by rotation of the drive stem 27. The cycle is repeated once the drive stem 27 reaches a point near the rig floor 13.

The invention has significant advantages. The lifting member on the rig floor provides assistance to the driller by allowing the driller to lift the stand, rather than bring the blocks downward. Locating a lifting member on the rig floor avoids placing complex power driven equipment in the derrick. Since the lifting device only lifts vertically, and is not required to perform other pipe handling operations, it is fairly simple and inexpensive. The pivotal mountings of the supporting and centralizing arms avoid obstructions in the area of the rig floor. The guide plates avoid wear on the bushing.

While the invention has been shown in only one of its forms, it should be apparent to those skilled in the art that it is not so limited, but is susceptible to various changes without departing from the scope of the invention.

I claim:

1. In a drilling rig having a rig floor through which a string of drill pipe made up of a plurality of stands extends, each stand having a threaded pin on the bottom, a derrick, (a power drive stem) adapted to be secured to an upper end of the string of drill pipe for rotating the string of drill pipe, a set of blocks carried by the derrick for raising and lowering the drive stem, and elevator means carried by the blocks for movement therewith below the drive stem for engaging and lifting one of the stands of drill pipe, an improved apparatus for assisting in connecting the stands of drill pipe to the drive stem, comprising in combination:

lifting means mounted to the rig floor and vertically movable between a lower position and an upper position;

a supporting arm mounted to the lifting means for vertical movement therewith; and receptacle means on the supporting arm for receiving the threaded pin of one of the stands of drill pipe when placed therein by the elevator means and blocks, allowing the lifting means to raise the supporting arm and the stand of drill pipe relative to the elevator means and blocks into engagement with the drive stem for connection.

2. In a drilling rig having a rig floor through which a string of drill pipe made up of a plurality of stands extends, a derrick, a power drive stem adapted to be secured to an upper end of the string of drill pipe for rotating the string of drill pipe, a set of blocks carried by the derrick for raising and lowering the drive stem, and elevator means carried by the blocks for movement therewith below the drive stem for engaging and lifting one of the stands of drill pipe, an improved apparatus for assisting in connecting the stands of drill pipe to the drive stem, comprising in combination:

a telescoping member mounted vertically to the rig floor;

a supporting arm mounted to the telescoping member;

receptacle means on the supporting arm for receiving the bottom of one of the stands of drill pipe when placed therein by the elevator means and blocks;

a centralizing arm mounted to the telescoping member above the supporting arm;

a pair of jaws on the centralizing arm for receiving the stand of drill pipe as the stand is positioned by the elevator means and blocks over the receptacle means, the jaws slidably engaging the stand to allow the stand to be lowered onto the receptacle means by the elevator means and blocks; and means for moving the telescoping member upward to raise the supporting arm and the stand of drill pipe relative to the elevator means and blocks into engagement with the drive stem for connection.

3. In a drilling rig having a rig floor through which a string of drill pipe made up of a plurality of stands extends, a derrick, a power drive stem adapted to be secured to an upper end of the string of drill pipe for rotating the string of drill pipe, a set of blocks carried by the derrick for raising and lowering the drive stem, and elevator means carried by the blocks for movement therewith below the drive stem for engaging and lifting one of the stands of drill pipe, an improved apparatus for assisting in connecting the stands of drill pipe to the drive stem, comprising in combination:

a telescoping member mounted vertically to the rig floor;

a supporting arm mounted to the telescoping member;

receptacle means on the supporting arm for receiving the bottom of one of the stands of drill pipe when placed therein by the elevator means and blocks;

a centralizing arm mounted to the telescoping member;

a pair of fixed open jaws on the centralizing arm for receiving the stand of drill pipe as the stand is positioned by the elevator means and blocks over the receptacle means;

spring means for allowing the jaws to deflect inward toward the telescoping member to absorb shock when the stand of drill pipe is swung into the jaws by the elevator means and blocks;

the jaws slidably engaging the stand of drill pipe to allow the stand to be lowered onto the receptacle means by the elevator means and blocks; and means for moving the telescoping member upward to raise the supporting arm and the stand of drill pipe relative to the elevator means and blocks into engagement with the drive stem for connection.

4. In a drilling rig having a rig floor containing a bushing through which a string of drill pipe made up of a plurality of stands extends, a derrick, a power drive stem adapted to be secured to an upper end of the string of drill pipe for rotating the string of drill pipe, a set of blocks carried by the derrick for raising and lowering the drive stem, and elevator means carried by the blocks for movement therewith below the drive stem for engaging and lifting one of the stands of drill pipe, an improved apparatus for assisting in connecting the stands of drill pipe to the drive stem, comprising in combination:

a telescoping member mounted vertically to the rig floor;

a supporting arm mounted to the telescoping member;

receptacle means on the supporting arm for receiving the bottom of one of the stands of drill pipe when placed therein by the elevator means and blocks;

mounting means for pivotally mounting the supporting arm to the telescoping member for movement between an operative position wherein the receptacle means is positioned above the bushing to an inoperative position;

a centralizing arm mounted to the telescoping member;

a pair of fixed open jaws on the centralizing arm for receiving the stand of drill pipe as the stand is positioned by the elevator means and blocks over the receptacle means;

mounting means for pivotally mounting the centralizing arm to the telescoping member between an operative position wherein the jaws are positioned above the bushing to an inoperative position;

the jaws slidably engaging the stand of drill pipe to allow the stand to be lowered onto the receptacle means by the elevator means and blocks; and means for moving the telescoping member upward to raise the supporting arm and the stand of drill pipe relative to the elevator means and blocks into engagement with the drive stem for connection.

5. In a drilling rig having a rig floor containing a bushing through which a string of drill pipe made up of a plurality of stands extends, a derrick, a power drive stem adapted to be secured to an upper end of the string of drill pipe for rotating the string of drill pipe, a set of blocks carried by the derrick for raising and lowering the drive stem, and elevator means carried by the blocks for movement therewith below the drive stem for engaging and lifting one of the stands of drill pipe, an improved apparatus for assisting in connecting the stands of drill pipe to the drive stem, comprising in combination:

a telescoping member mounted vertically to the rig floor;

a supporting arm mounted to the telescoping member;

receptacle means on the supporting arm for receiving the bottom of one of the stands of drill pipe when placed therein by the elevator means and blocks;

means for moving the telescoping member upward to raise the supporting arm and the stand of drill pipe relative to the elevator means and blocks into engagement with the drive stem for connection;

a pair of guide plates, each having a semi-circular opening on an edge that mates with the other to define a circular hole with a diameter less than the diameter of the bushing for receiving and centering the drill string in the bushing; and means for mounting the guide plates to the rig floor on opposite sides and above the bushing for movement between an operative positioned over the bushing and an inoperative position positioned away from the bushing.

6. In a drilling rig having a rig floor, a derrick, a power drive assembly carried in the derrick including a rotatably driven tubular drive stem, a pair of links hooked to the power drive assembly for swinging movement, extending downward from the power drive assembly alongside and below the drive stem, a set of elevators carried on the lower ends of the links, the elevators having two halves hinged together and movable between open and closed positions to releasably and slidably clamp around a drill pipe for lifting the drill pipe, the improvement comprising in combination:

stabilizing means mounted to the links for locking the links to the drive stem while the elevators are in the closed position, and for releasing the links from the drive stem when the elevators are moved to the open position; and lifting means located on the rig floor for lifting the drill pipe upward relative to the drive stem to slide through the elevators into contact with the drive stem for connection to the drive stem.

7. In a method of drilling having the steps of suspending a power drive stem in a drilling rig with a set of blocks, rotating with the drive stem a string of drill pipe made up of a plurality of stands and extending through a rig floor, and lifting the string of drill pipe while disconnected from the drive stem with a set of elevators carried by the blocks for movement therewith below the drive stem, an improved method for connecting the stands of drill pipe to the drive stem, comprising in combination:

mounting to the rig floor a lifting member;

engaging the upper end of one of the stands of drill pipe with the elevators; then engaging the lower end of the stand of drill pipe with the lifting member; then moving the stand of drill pipe upward relative to the blocks with the lifting member, allowing the stand of drill pipe to slide in the elevators until the upper end of the stand of drill pipe engages the drive stem; then holding the stand of drill pipe stationary and rotating the drive stem to connect the drive stem to the stand of drill pipe.

* * * * *